US009015897B2

(12) United States Patent
Jonsson et al.

(10) Patent No.: US 9,015,897 B2
(45) Date of Patent: Apr. 28, 2015

(54) DUST DETECTION SYSTEM

(75) Inventors: Stefan Jonsson, Stockholm (SE); Fredrik Sjöberg, Bromma (SE)

(73) Assignee: Aktiebolaget Electrolux (SE)

( * ) Notice: Subject to any disclaimer, the term of this patent is extended or adjusted under 35 U.S.C. 154(b) by 194 days.

(21) Appl. No.: 13/807,567

(22) PCT Filed: Jun. 28, 2011

(86) PCT No.: PCT/EP2011/060813

§ 371 (c)(1), (2), (4) Date: Mar. 13, 2013

(87) PCT Pub. No.: WO2012/000990

PCT Pub. Date: Jan. 5, 2012

(65) Prior Publication Data

US 2013/0205537 A1 Aug. 15, 2013

Related U.S. Application Data

(60) Provisional application No. 61/361,090, filed on Jul. 2, 2010.

(30) Foreign Application Priority Data

Jun. 29, 2010 (SE) ..... 1000699

(51) Int. Cl.

| | |
|---|---|
| ***A47L 9/19*** | (2006.01) |
| ***A47L 9/28*** | (2006.01) |
| *A47L 9/16* | (2006.01) |

(52) U.S. Cl.

CPC ..... *A47L 9/2815* (2013.01); *A47L 9/1608* (2013.01); *A47L 9/1683* (2013.01); *A47L 9/19* (2013.01); *A47L 9/2857* (2013.01); *A47L 9/2894* (2013.01)

(58) Field of Classification Search

CPC ..... A47L 9/1608; A47L 9/19
USPC ..... 15/319, 339, 347, 352, 353
IPC ..... A47L 9/19
See application file for complete search history.

(56) References Cited

U.S. PATENT DOCUMENTS

| | | | |
|---|---|---|---|
| 3,199,138 | A | 8/1965 | Nordeen |
| 4,601,082 | A | 7/1986 | Kurz |

(Continued)

FOREIGN PATENT DOCUMENTS

| | | |
|---|---|---|
| EP | 0347223 | 12/1989 |
| EP | 0 456 084 A1 | 11/1991 |

(Continued)

OTHER PUBLICATIONS

International Search Report from International Patent Application No. PCT/EP2011/060813, mailed Nov. 22, 2011.

(Continued)

*Primary Examiner* — David Redding
(74) *Attorney, Agent, or Firm* — RatnerPrestia

(57) ABSTRACT

There is provided a dust detection system for a vacuum cleaner comprising a dust separation chamber (20) of cyclone type and having a separate dustbin (30) for collecting separated dust. The dust separation chamber is adapted to provide a generally cyclonic airflow for separating dust from a dust laden air stream, and is at a bottom (25) of the dust separation chamber connected via an outlet (22) to the dustbin. The dust detection system further comprises an emitter (41) positioned to emit an electromagnetic signal into the dust separation chamber during operation of the vacuum cleaner, and a receiver (42) positioned to receive the electromagnetic signal. The inventive concept is based on an understanding that when the dustbin becomes full, dust accumulates at the bottom of the dust separation chamber, i.e. stays rotating at the bottom, since it cannot enter the dustbin. The emitter and receiver are positioned in a bottom portion (26) of the dust separation chamber and are arranged to detect dust accumulating at the bottom portion during operation of the vacuum cleaner, thereby providing an indication of the dustbin being full.

20 Claims, 3 Drawing Sheets

(56) References Cited

U.S. PATENT DOCUMENTS

| | | | |
|---|---|---|---|
| 4,680,827 | A | 7/1987 | Hummel |
| 4,769,535 | A | 9/1988 | Sasaki et al. |
| 4,920,605 | A | 5/1990 | Takashima |
| 4,937,912 | A | 7/1990 | Kurz |
| 4,942,640 | A | 7/1990 | Hayashi et al. |
| 5,134,749 | A | 8/1992 | Sakurai et al. |
| 5,144,714 | A | 9/1992 | Mori et al. |
| 5,144,715 | A | 9/1992 | Matsuyo et al. |
| 5,152,028 | A | 10/1992 | Hirano |
| 5,163,202 | A | 11/1992 | Kawakami et al. |
| 5,182,833 | A | 2/1993 | Yamaguchi et al. |
| 5,216,777 | A | 6/1993 | Moro et al. |
| 5,233,682 | A | 8/1993 | Abe et al. |
| 5,251,358 | A | 10/1993 | Moro et al. |
| 5,319,827 | A | 6/1994 | Yang |
| 5,323,483 | A | 6/1994 | Baeg |
| 5,515,572 | A | 5/1996 | Hoekstra et al. |
| 5,539,953 | A | 7/1996 | Kurz |
| 5,542,146 | A | 8/1996 | Hoekstra et al. |
| 5,613,261 | A | 3/1997 | Kawakami et al. |
| 5,815,884 | A | 10/1998 | Imamura et al. |
| 5,819,367 | A | 10/1998 | Imamura |
| 6,023,814 | A | 2/2000 | Imamura |
| 6,055,702 | A | 5/2000 | Imamura et al. |
| 6,323,570 | B1 | 11/2001 | Nishimura et al. |
| 6,400,048 | B1 | 6/2002 | Nishimura et al. |
| 6,437,465 | B1 | 8/2002 | Nishimura et al. |
| 6,910,245 | B2 | 6/2005 | Hawkins et al. |
| 2004/0177467 | A1 | 9/2004 | Jones et al. |
| 2005/0138763 | A1 | 6/2005 | Tanner et al. |
| 2007/0180649 | A1 | 8/2007 | Pullins |
| 2007/0214597 | A1 | 9/2007 | Suzuki |
| 2008/0047091 | A1 | 2/2008 | Nguyen |
| 2010/0236013 | A1 | 9/2010 | Sjoberg et al. |

FOREIGN PATENT DOCUMENTS

| | | |
|---|---|---|
| EP | 1836941 | 9/2007 |
| JP | 0327936 | 8/1989 |
| JP | 2-049621 A | 2/1990 |
| WO | WO 01/08544 A1 | 2/2001 |

OTHER PUBLICATIONS

"Self Cleaning Bagless" by Panasonic Consumer Electronics, Co. (undated, but admitted to be prior art).

International Search Report for PCT International Application PCT/US2010/027637 dated May 19, 2010.

International Search Report for PCT International Application PCT/EP2011/060814 dated Nov. 22, 2011.

International Written Opinion for PCT International Application PCT/ EP2011/060814 dated Jan. 8, 2013.

Entire patent prosecution history of U.S. Appl. No. 13/807,562, filed Mar. 6, 2013, entitled, "Dust Indicator for a Vacuum Cleaner".

Entire patent prosecution history of U.S. Appl. No. 12/405,742, filed Mar. 17, 2009, entitled, "Vacuum Cleaner Sensor".

DUST DETECTION SYSTEM

CROSS REFERENCE TO RELATED APPLICATIONS

This application is a national stage application filed under 35 U.S.C. 371 of International Application No. PCT/EP2011/060813, filed Jun. 28, 2011, which claims priority from Swedish Patent Application No. 1000699-7, filed Jun. 29, 2010, and U.S. Provisional Patent Application No. 61/361,090, filed Jul. 2, 2010, each of which is incorporated herein in its entirety.

TECHNICAL FIELD

The present invention generally relates to a dust detection system for use in vacuum cleaners that employ a cyclonic type dust separation chamber, and more particularly to a dust detection system for indicating a full dustbin.

BACKGROUND OF THE INVENTION

Vacuum cleaners that employ a cyclonic cleaning system, such as upright and canister vacuum cleaners, stick vacuums, central vacuums etc. are common on the market today. Dust from the dust laden airstream which is sucked into the vacuum cleaner is separated in a dust separation chamber and collected in a dustbin, which must be frequently emptied by the user. As long as the dust level in the dustbin is below a critical level, normal functionality of the dust separation in the vacuum cleaner is provided.

However, a common problem for vacuum cleaners with a separate dustbin is that the user forgets to empty the dustbin before the critical level is reached, which results in unnecessary clogging of filters and other parts of the vacuum cleaner. The consequences of this are loss of cleaning performance and increased amount of maintenance of e.g. the main filter and filter screen. Thus, there is a need for indicating to the user when it is time to empty the dustbin before the critical level is reached.

It is known to arrange optical dust indicators in vacuum cleaners for the purpose of detecting dust. The optical dust indicators are typically based on optical sensors providing a detection system, such as a light emitter in combination with a light receiver, which are arranged such that when dust is present in the optical path of the light signal provided by the light emitter, the light receiver detects a decreased or blocked light signal. The optical dust indicators are sensitive to dust getting stuck somewhere in the optical path of the detection system, as this blocks the light signal.

SUMMARY

In view of the above, an objective of the invention is to solve or at least reduce the problems discussed above. In particular, an objective is to provide an efficient way of indicating a full dustbin, which dustbin is connected to a cyclonic type dust separation chamber. The inventive concept is based on an understanding that when a dustbin connected to a cyclonic type dust separation chamber becomes full, dust accumulates at the bottom of the dust separation chamber, i.e. stays rotating at the bottom, since it cannot enter the dustbin. Further, the strong cyclonic airstream in a cyclone type dust separation chamber keeps the walls of the bottom portion of the dust separation chamber free from dust and dirt during normal operation such that dust contamination of a dust detection system thereof is kept at a minimum.

According to a first aspect of the present invention, there is provided a dust detection system for a vacuum cleaner comprising a dust separation chamber having an inlet for receiving a dust laden air stream. The dust separation chamber is adapted to provide a generally cyclonic airflow for separating dust from the dust laden air stream, and has an outlet arranged at a bottom of the dust separation chamber. The outlet is connected to a dustbin for collecting the separated dust. The dust detection system further comprises an emitter positioned to emit an electromagnetic signal into the dust separation chamber during operation of the vacuum cleaner, and a receiver positioned to receive the electromagnetic signal. The emitter and receiver are positioned in a bottom portion of the dust separation chamber and are arranged to detect dust accumulating at the bottom portion during operation of the vacuum cleaner, thereby providing an indication of the dustbin being full.

The cyclonic airflow in a dust separation chamber of cyclonic type which is connected to a dustbin typically provides a zone at the bottom of the dust separation chamber that during normal working conditions, when the dustbin is not yet full, is kept free from dust getting stuck along its inner wall. The cyclonic airflow prevents dust particles from sticking and further transports the separated dust into the dustbin via the outlet. Thus, it is advantageous to position the emitter and receiver of the dust detection system at the bottom of the dust separation chamber as the cyclonic airflow keeps them free from dust. The emitter and receiver may be positioned diametrically oppositely to each other such that the electromagnetic signal travels diametrically through the dust separation chamber, or at positions such that the electromagnetic signal travels along a chord of the dust separation chamber. Further, as the dustbin gets full, the separated dust will accumulate at the bottom of the dust separation chamber. By detecting the accumulated dust, which will block the electromagnetic signal of the emitter and receiver, an indication of the dustbin being full is provided.

According to an embodiment of the dust detection system, the bottom portion extends from the bottom of the dust separation chamber to a height corresponding to an upper rim of the outlet. This defines a portion of the dust separation chamber which is subjected to the self cleaning effect of the cyclonic airflow, and which is the first portion of the dust separation chamber at which dust starts accumulating when the dustbin is getting full.

According to an embodiment of the dust detection system, it comprises a protruding element arranged at the bottom of the dust separation chamber. The protruding element is arranged for facilitating the cyclonic airflow.

The protruding element may be e.g. a bell shaped body or protrusion arranged in a middle portion of the bottom of the dust separation chamber. The protruding element facilitates the cyclonic airflow at the bottom of the dust separation chamber. Thereby the cyclonic airflow speeds up along the inner wall of the dust separation chamber, forcing dust towards the outlet and into the dustbin. The higher speed of the cyclonic air flow is advantageous for keeping the emitter and receiver free from dust.

According to an embodiment of the dust detection system, the emitter and receiver are arranged such that the electromagnetic signal is reflected in the protruding element. This is advantageous as the emitter and receiver can then be placed adjacent to each other. Thereby, a more compact detection system is achieved According to an embodiment of the dust detection system, the protruding element comprises a reflective surface. The reflective surface provides a stronger reflection of the electromagnetic signal to be detected by the receiver, thereby improving the signal to noise ratio of the dust detection system.

According to an embodiment of the dust detection system, the electromagnetic signal comprises a wavelength within the visible range of the electromagnetic spectrum, or a wavelength within the infrared range of the electromagnetic spectrum. By utilizing a certain wavelength of the electromagnetic signal, the dust detection system may be arranged to be less sensitive to stray light or other electromagnetic energies present in the surroundings. In addition, a decreased sensitivity to surrounding noise and reflections for the dust detection system may be provided by modulating the electromagnetic signal, e.g. by frequency modulation or any other suitable modulation technique.

According to an embodiment of the dust detection system, the dust detection system further comprises a control system for providing an indication when the received electromagnetic signal of the receiver is at least one of a constant predetermined level, and a flashing predetermined level. The accumulated dust at the bottom of the dust separation chamber may be a sufficient amount of dust or opaque enough to provide a constant blocking of the electromagnetic signal, thereby indicating a full dustbin. However, if there is accumulated debris, the electromagnetic signal is blocked with the periodicity of the encircling debris, which also may indicate a full dustbin.

According to an embodiment of the dust detection system, the indication is activated if the constant predetermined level or the flashing predetermined level is detected during a predetermined time period. This is advantageous for different situations. For instance it can be utilized to avoid a false indication of the dustbin being full when during vacuum cleaning an extraordinary amount of dust is entered into the system via the dust laden airstream. The high amount of dust may temporarily block the electromagnetic signal before entering into the dustbin, and thereby falsely indicate a full dustbin. Further, another possible situation is when debris is temporarily encircling the bottom portion of the dust separation chamber and blocking the electromagnetic signal with a periodicity instead of a full time blocked electromagnetic signal. If the flashing signal is detected during a predetermined time it is then interpreted as a blocked signal, i.e. a full dustbin, but if the flashing signal is just debris which is subsequently transported into the dustbin before the predetermined time has passed, the flashing signal is ignored.

According to an embodiment of the dust detection system, the dust detection system further comprises shielding means for limiting the angle of reception of the receiver. This is advantageous to avoid multiple reflected signals from within the dust separation chamber and stray light, which improves the reliability of the dust detection system.

According to an embodiment of the dust detection system, the shielding means is an opaque cover, an opaque tape, or a countersink arranged in the wall of the dust separation chamber in which the receiver is arranged.

According to a second aspect of the present invention, there is provided a vacuum cleaner comprising a dust detection system according to the invention.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise.

Other objectives, features and advantages of the present invention will appear from the following detailed disclosure, from the attached dependent claims as well as from the drawings.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF PREFERRED EMBODIMENTS

Figure 1:
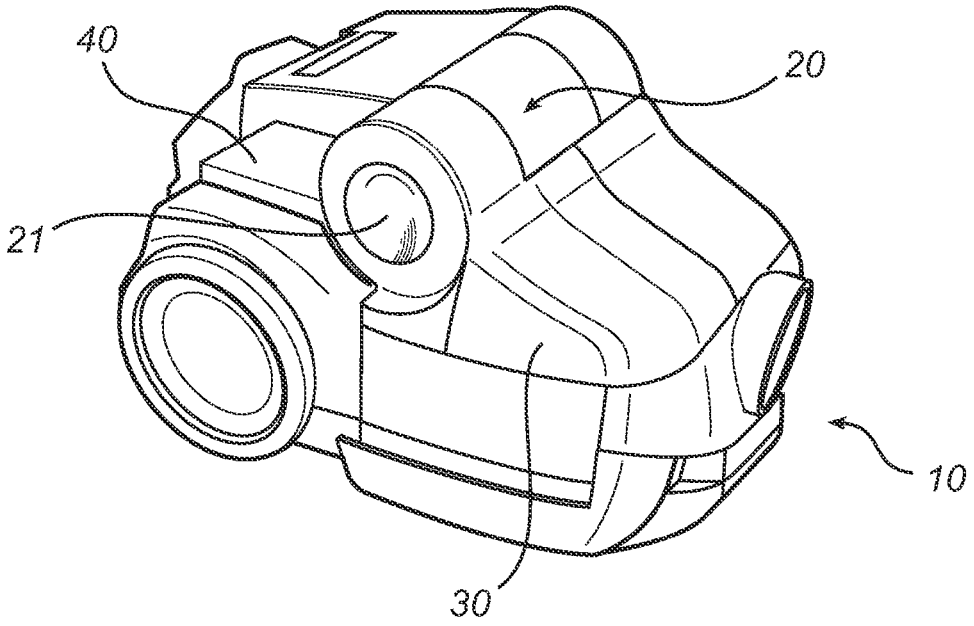
FIG. 1 is a vacuum cleaner comprising a dust detection system according to the present inventive concept.

FIG. 1 illustrates a vacuum cleaner 10 of canister type which has a housing on which a dust separation chamber 20 of cyclone type is arranged. The dust separation chamber 20 is at its bottom connected to a dustbin 30 and a dust detector unit 40. The vacuum cleaner 10 typically comprises components such as a power unit, a vacuum source, a suction pipe, a floor nozzle etc. (not shown) for achieving the dust and dirt cleaning capability of the vacuum cleaner. However, because these dust and/or dirt sucking operation principles of the vacuum cleaner are not critical to the implementation of the present invention, detailed description thereof is omitted.

Figure 2:
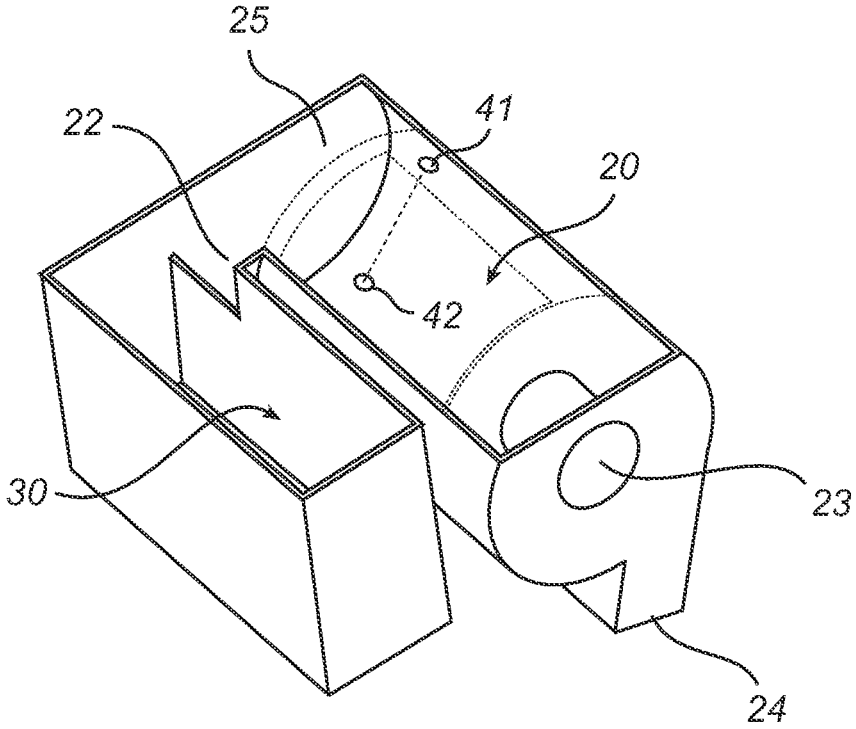
FIG. 2 is a schematic cross-sectional view of an embodiment of a dust detection system according to the present inventive concept.

To continue, and with reference to FIG. 2, the dust separation chamber 20 is utilized to separate dust and dirt from a dust laden air stream typically entered into the vacuum cleaner via the floor nozzle and into the dust separation chamber 20 via an inlet 24. The dust separation chamber 20 is here substantially cylindrical, however any other shape suitable for promoting air to form a cyclone or another substantially circular or helical motion of the airflow is applicable. The airflow inside the dust separation chamber 20 of this cyclone type creates a vortex that flings heavier dust particles and debris to the periphery, i.e. towards the inner wall of the dust separation chamber 20, where they travel towards the bottom 25, while relatively clean air escapes the vacuum port at a top outlet 23 of the dust separation chamber 20. At the bottom 25 of the dust separation chamber 20, the dust particles and debris are transported via an outlet 22 into the dustbin 30. When the dustbin 30 is filled with dust and debris, the outlet 22 is blocked and dust coming into the dust separation chamber 20 starts accumulating at the bottom portion 25. An emitter 41 positioned to emit an electromagnetic signal into the dust separation chamber 20 during operation of the vacuum cleaner, and a receiver 42 positioned to receive the electromagnetic signal, are here arranged such that the electromagnetic signal travels along a chord of the dust separation chamber 20. The emitter 41 and receiver 42 may be part of the dust detector unit 40 shown in FIG. 1.

Figure 3:
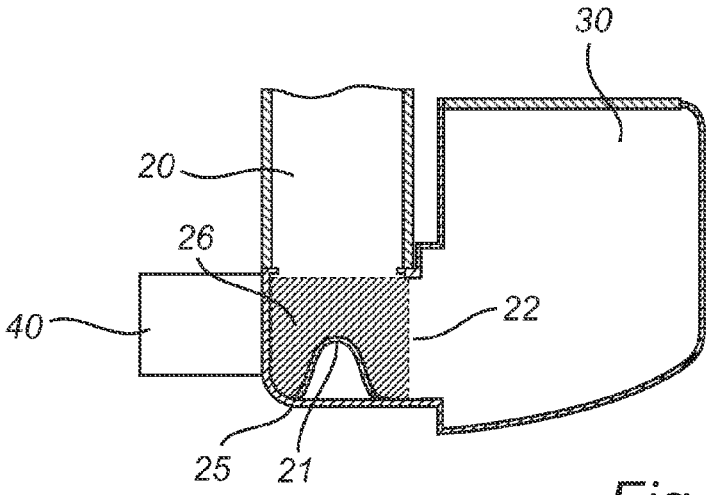
FIG. 3 is a schematic cross-sectional view of an embodiment of a dust detection system according to the present inventive concept.

A top view of an embodiment of the dust indicator system according to the present invention is illustrated in FIG. 3. The dust separation chamber 20 is here provided with a protruding element 21 arranged at the bottom 25, which protruding element is hereinafter referred to as vortex guide 21. The vortex guide 21 is bell shaped and arranged for facilitating the creation of a strong vortex in a bottom portion 26 of the dust separation chamber 20, the bottom portion being substantially defined by the outlet 22, i.e. the portion of the dust separation chamber 20 extending from the bottom 25 to the height of the upper rim of the outlet 22, as illustrated in FIG. 3. Thus, the vortex guide increases the speed of the cyclonic airflow, such that the dust particles are efficiently transported into the dustbin 30, while simultaneously keeping the inner wall of the dust separation chamber 20 at the bottom portion 26 free from dust.

Figure 4A:
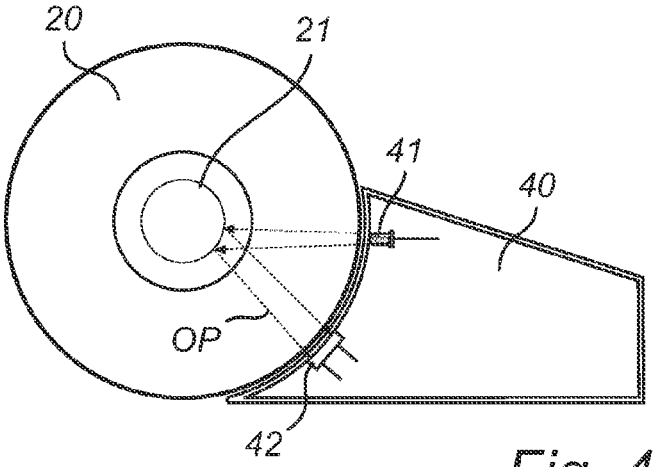
FIGS. 4*a* and 4*b* illustrate cross-sectional views of an embodiment of a dust detection system according to the present inventive concept.
Figure 4B:
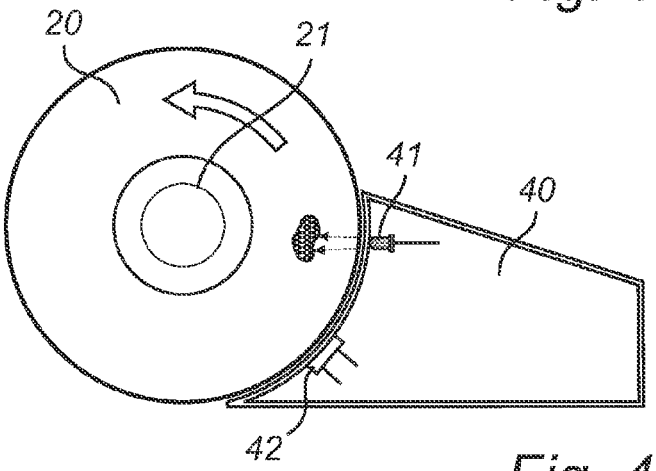

A dust detector unit 40 is arranged at the bottom portion 26. As illustrated in FIGS. 4*a* and 4*b*, which schematically illustrate a dust detector 40 comprising an emitter 41 positioned to emit an electromagnetic signal into the dust separation chamber 20 during operation of the vacuum cleaner, and a receiver 42 positioned to receive the electromagnetic signal. In the arrangement in FIGS. 4*a* and 4*b*, the emitter 41 and receiver 42 are arranged such that the electromagnetic signal is reflected in the vortex guide 21. The vortex guide 21 may be at least partly coated with a metal, or other reflective material, for facilitating the reflection of the electromagnetic signal. Thereby, the electromagnetic signal follows an optical path OP inside the dust separation chamber 20. When dust accumulates at the bottom portion 26 during operation of the vacuum cleaner, it will pass through the optical path, as illustrated in FIG. 4*b*, and thus block the electromagnetic signal thereby providing an indication of a full dustbin 30. The emitter 41 may be any electronic apparatus capable of transmitting electromagnetic energy. For example, the emitter may emit visible light, or may emit infrared or ultraviolet light.

In an embodiment of the dust detection system, in a dust separation chamber with no vortex guide, the emitter and the receiver are arranged separated on, and optionally on opposite sides of, the dust separation chamber walls, such that the optical path extends diametrically over the space within the dust separation chamber from one side to another or along a chord of the space within the dust separation chamber (see FIG. 2). Alternatively, the emitter and receiver may be arranged such that the electromagnetic signal travels from the emitter and is reflected in the wall before being received by the receiver. In this case, the wall may further be arranged having a reflective layer to facilitate the reflection of the electromagnetic signal.

In the embodiment of the dust detection system as illustrated in FIG. 4*a*, the emitter 41 is an IR-LED (infrared light emitting diode) which is modulated with an 8 kHz frequency. The emitter 41 emits an IR-signal which is reflected in the vortex guide 21, which is arranged at the bottom 25 of the dust separation chamber 20. If no dust is rotating at the bottom of the dust separation chamber, the dustbin is not full and the IR-signal reaches the receiver 42 and no indication of dust occurs. With a full dustbin 30, the outlet 22 for transporting the separated dust into the dustbin 30 becomes blocked such that dust starts rotating at the bottom 25 of the dust separation chamber 20, see FIG. 4*b*. The IR-signal is thus blocked by the rotating dust, at which event no IR-signal (or a decreased IR-signal) reaches the receiver 42 and a full dustbin is alarmed.

In an embodiment of the dust detection system, the emitter and receiver are part of a control system which may comprise a microprocessor which is arranged to handle the indication of the full dustbin. To avoid false indication of the dustbin being full, for instance when temporary blocking of the optical signal between the emitter and the receiver occurs due to a large amount of dust entering the dust separation chamber during normal cleaning, a time delay is employed such that the optical signal between the emitter and the receiver must be blocked for a certain predetermined time before the control system indicates full dustbin.

According to an embodiment of the dust detection system, the control system is arranged to handle a flashing signal which is detected due to rotating dust. Rotating dust or debris may temporarily be present at the bottom of the dust separation chamber without the dustbin actually being full. In this case the rotating dust or debris is subsequently transported into the dustbin. The control system is arranged to set a timer when the receiver detects a change in the received electromagnetic signal, e.g. going from full signal (an initial value) to a lower value when debris passes through the optical path. If the received signal keeps flashing throughout the predetermined set time interval of the timer, e.g. 15 s, an indication of full dustbin is set. If the flashing signal stops before the 15 s have passed, and the received signal reverts back to its initial value, the timer is reset. The indication of a full dustbin may be used to control a lamp, a buzzer or a display for informing the user that the dustbin is full and needs to be emptied.

According to an embodiment of the dust detection system, at least the receiver is shielded off by some shielding means (not shown) such that the angle of reception of the receiver is limited. This is to limit the amount of disturbances which may reach the receiver. The disturbances may be caused by e.g. ambient light entering the dust separation chamber or dustbin which may be manufactured in a transparent plastic material, or unintended reflections of the electromagnetic signal within the dust separation chamber. The shielding means may be an opaque cover, e.g. a black plastic element with an oblong hole, an opaque tape, or a countersink arranged in the wall of the dust separation chamber in which the receiver is arranged.

Above, embodiments of the wash arm arrangement according to the present invention as defined in the appended claims have been described. These should be seen as merely non-limiting examples. As understood by a skilled person, many modifications and alternative embodiments are possible within the scope of the invention.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A dust detection system for a vacuum cleaner comprising a dirt separation chamber having an inlet for receiving a dust laden air stream, said dust separation chamber being adapted to provide a generally cyclonic airflow for separating dust from said dust laden air stream, and having an outlet arranged at a bottom of said dust separation chamber, said outlet being connected to a dustbin for collecting said separated dust, said dust detection system further comprising:

an emitter positioned to emit an electromagnetic signal into said dust separation chamber during operation of the vacuum cleaner; and a receiver positioned to receive said electromagnetic signal;

wherein said emitter and receiver are positioned in a bottom portion of said dust separation chamber and being arranged to detect dust accumulating at said bottom portion during operation of the vacuum cleaner, thereby providing an indication of said dustbin being full; and wherein said bottom portion extends from said bottom of the dust separation chamber to a height corresponding to an upper rim of said outlet.

2. A dust detection system according to claim 1, further comprising a protruding element arranged at said bottom of said dust separation chamber, said protruding portion being arranged for facilitating said cyclonic airflow.

3. A dust detection system according to claim 2, wherein said emitter and receiver are arranged such that said electromagnetic signal is reflected in said protruding element.

4. A dust detection system according to claim 2, wherein said protruding element comprises a reflective surface.

5. A dust detection system according to claim 1, wherein said electromagnetic signal comprises a wavelength within the visible range of the electromagnetic spectrum, or a wavelength within the infrared range of the electromagnetic spectrum.

6. A dust detection system according to claim 1, further comprising a control system for providing an indication when the received electromagnetic signal of said receiver is at least one of a constant predetermined level, and a flashing predetermined level.

7. A dust detection system according to claim 6, wherein said indication is activated if the constant predetermined level or the flashing predetermined level is detected during a predetermined time period.

8. A dust detection system according to claim 1, further comprising shielding means for limiting the angle of reception of said receiver.

9. A dust detection system according to claim 8, wherein said shielding means is an opaque cover, an opaque tape, or a countersink arranged in the wall of the dust separation chamber in which said receiver is arranged.

10. A vacuum cleaner comprising a dust detection system according to claim 1.

11. A dust detection system for a vacuum cleaner comprising a dirt separation chamber having an inlet for receiving a dust laden air stream, said dust separation chamber being adapted to provide a generally cyclonic airflow for separating dust from said dust laden air stream, and having an outlet arranged at a bottom of said dust separation chamber, said outlet being connected to a dustbin for collecting said separated dust, said dust detection system further comprising:

an emitter positioned to emit an electromagnetic signal into said dust separation chamber during operation of the vacuum cleaner;

a receiver positioned to receive said electromagnetic signal; and a protruding element arranged at said bottom of said dust separation chamber, said protruding portion being arranged for facilitating said cyclonic airflow;

wherein said emitter and receiver are positioned in a bottom portion of said dust separation chamber and being arranged to detect dust accumulating at said bottom portion during operation of the vacuum cleaner, thereby providing an indication of said dustbin being full.

12. A dust detection system according to claim 11, wherein said bottom portion extends from said bottom of the dust separation chamber to a height corresponding to an upper rim of said outlet.

13. A dust detection system according to claim 11, wherein said emitter and receiver are arranged such that said electromagnetic signal is reflected in said protruding element.

14. A dust detection system according to claim 11, wherein said protruding element comprises a reflective surface.

15. A dust detection system according to claim 11, wherein said electromagnetic signal comprises a wavelength within the visible range of the electromagnetic spectrum, or a wavelength within the infrared range of the electromagnetic spectrum.

16. A dust detection system according to claim 11, further comprising a control system for providing an indication when the received electromagnetic signal of said receiver is at least one of a constant predetermined level, and a flashing predetermined level.

17. A dust detection system according to claim 16, wherein said indication is activated if the constant predetermined level or the flashing predetermined level is detected during a predetermined time period.

18. A dust detection system according to claim 11, further comprising shielding means for limiting the angle of reception of said receiver.

19. A dust detection system according to claim 18, wherein said shielding means is an opaque cover, an opaque tape, or a countersink arranged in the wall of the dust separation chamber in which said receiver is arranged.

20. A vacuum cleaner comprising a dust detection system according to claim 11.

* * * * *